US005611537A

United States Patent [19]

Burtt

[11] Patent Number: 5,611,537

[45] Date of Patent: Mar. 18, 1997

[54] BOARD GAME APPARATUS

[76] Inventor: Rodney B. Burtt, Tring House, 130 High Street, Hadleigh, Ipswich, Suffolk, IP7 5EL, United Kingdom

[21] Appl. No.: 633,568

[22] Filed: Apr. 17, 1996

[51] Int. Cl.[6] ..... A63F 3/00

[52] U.S. Cl. ..... 273/249

[58] Field of Search ..... 273/242, 243, 273/248, 249, 256, 278

[56] References Cited

U.S. PATENT DOCUMENTS

| | | | |
|---|---|---|---|
| 4,529,205 | 7/1985 | Bowker | 273/256 |
| 4,898,390 | 2/1990 | De Villiers | 273/249 |
| 5,071,134 | 12/1991 | Burroughs, Jr. | 273/249 |
| 5,259,623 | 11/1993 | Kanelos | 273/249 |
| 5,511,792 | 4/1996 | Simmons et al. | 273/249 X |
| 5,516,290 | 5/1996 | Quigley et al. | 273/249 X |

FOREIGN PATENT DOCUMENTS

| | | | |
|---|---|---|---|
| 2254565 | 10/1992 | United Kingdom | 273/249 |

*Primary Examiner*—William E. Stoll

*Attorney, Agent, or Firm*—Kokjer, Kircher, Bowman & Johnson

[57] ABSTRACT

The invention relates to a board game based on wines and the wine regions of the world. The board game has a plurality of zones through which players move in accordance with the throw of a die or dice to gain assets in the wine industry; players with sufficient assets being enabled to proceed to a further zone. The winner is the player who first accumulates enough assets to purchase a special property.

12 Claims, 2 Drawing Sheets

BOARD GAME APPARATUS

FIELD OF THE INVENTION

This invention relates to a board game for a plurality of players, preferably two to four players.

BACKGROUND OF THE INVENTION

Although the board game may be based on many activities, in a preferred embodiment, it is based on wines and the wine regions of the world.

The wine trade is a subject which has been written about ad infinitum, yet the majority of these books are fairly dry and fail to convey the love and discernment felt by those in the trade. In particular, it is difficult as a trainee in this area to gain much useful information and understanding from the works currently on the market. The trade is divided between growers, producers, retailers and auction houses and it is necessary to understand how these interact with one another. This situation is not unique to the wine trade but also occurs in other fields such as architecture.

An aim of the present invention is to provide board game apparatus which may be used in an educational fashion.

SUMMARY OF THE INVENTION

According to the present invention there is provided board game apparatus comprising a board, which board comprises a first sector and a second sector, the first sector comprising a first linear path laid out to locations, some at least of which locations are sequentially numbered and other locations relate to game instructions;

the second sector comprising a network of paths laid out to further locations, which locations relate to the gaining of assets, which apparatus further comprises a first pack of cards relating to assets associated with the said numbered locations, a second pack of cards giving game instructions, a third pack of cards relating to the assets to be gained in said second sector, player markers, at least one die, and a fourth pack of cards relating to a winning set of assets.

In a preferred embodiment, the first sector comprises two zones, the assets in the first zone having a first range of values and the assets of the second zone having a second range of values higher than the first range. The second sector may comprise a third zone, and there may be provided a fourth zone containing a plurality of said special properties.

When a plurality of special properties are provided, each of the prime locations of the third zone may indicate a particular special property which the holder of that prime location must endeavour to purchase in order to win the game.

In a preferred embodiment, the first zone has a plurality of special locations interspersed with the numbered locations of the first zone, a player landing on a special location receiving, selectively, a bonus, a forfeit or a pass to the second zone.

In a preferred embodiment to be described in greater detail hereinafter, the zones are coloured, the first zone being yellow, the second blue, the third pink and the fourth gold. The assets in the first zone may consist of bottles of wine, the pass may consist of a Cellarer card representative of a type of wine such as Sauternes. In the second zone, each numbered location may be representative of a certain area and its assets may consist of rows of vines and the forfeits may consist of a direction to proceed to another location in either this zone or in the first zone.

In the second zone, each numbered location may be representative of a certain area and its asset will be in rows of vines.

The third zone or pink zone preferably consists of thirty locations divided into eleven regions each region having a prime location. The fourth zone preferably consists of only four locations. Preferably, each location in the fourth zone is identified with a special property such as a particular high quality vineyard or chateau.

Although the preferred form of the game relates to wine, it is envisaged that the basic concept of the game will comprise a teaching aid as well as entertainment. For example each of the locations and cards will contain information on the specific wine and/or on the wine region in such a way that the type of grape, type of wine and quality of wine may be linked so that in any one game a player may find himself or herself concentrating on a particular aspect of wine.

Other concepts for the game may be based on a study of architectural styles through the ages, geography or history. As an example of the latter, the game may be based on the concept of the building up of alliances and collecting troops to fight the Battle of Waterloo. In this way, school children could learn history at an almost subconscious level.

DETAILED DESCRIPTION OF THE INVENTION

A preferred embodiment of the invention relating specifically to a game based on wines and vineyards will now be described by way of example only, with reference to the drawings in which.

Figure 1:
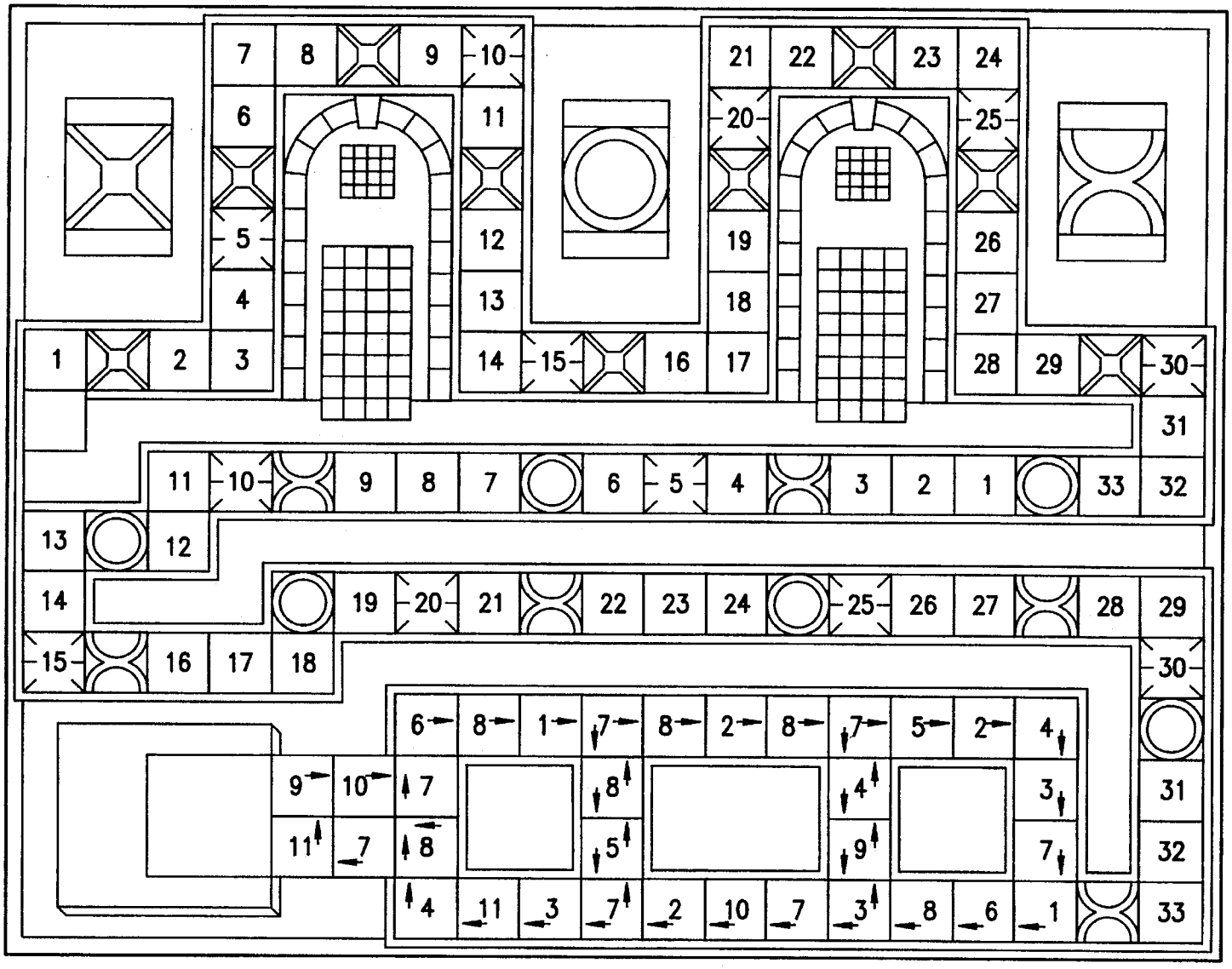
FIG. 1 shows a game board.
Figure 4:
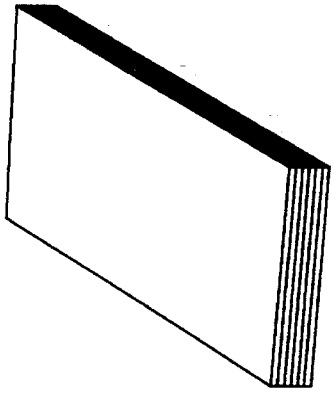
FIGS. 2–5 show a respective pack of cards.
Figure 7:
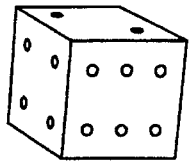
Figure 3:
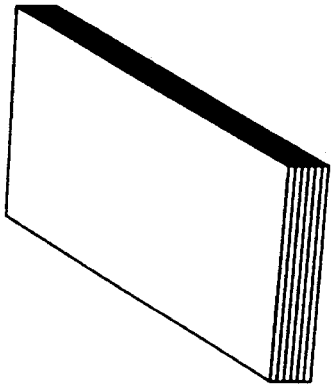
Figure 6:
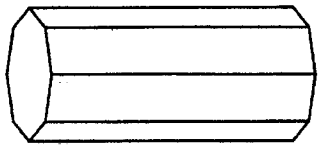
Figure 2:
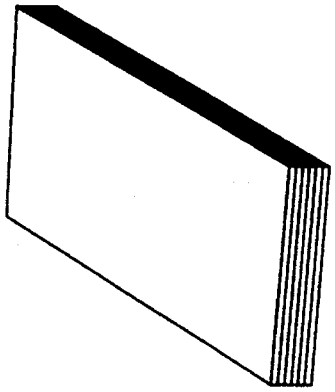
Figure 5:
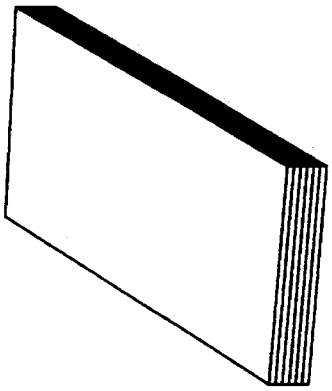

FIG. 6 a player marker and

FIG. 7 a die.

The game is known as VINESQUE and is a board game for two, three or four players. The play consists of collecting numbered Wine District Cards on the VINESQUE playing board within the Yellow and Blue Zones. The Cellarer squares (Yellow Zone) and the Disaster Bin and Europa squares (Blue Zone) determine the players' fortunes as the game progresses.

The winning player is the first one to claim a Gold Zone square by way of Property Cards collected in the Pink Zone. He or she must also have the highest combination of Funds from both their Pink Zone and Gold Zone Property Cards. (District Card Funds hold no value for a winning player because these Funds are used only for purchasing opponents' Property Cards.)

Preparation of the Board

Unfold the board and position on a table so that all players have clear vision of the layout.

Take out the small packs of cards, namely Cellarer, Disaster Bin and Europa. Shuffle and place them on their marked grids, ensuring that all the captions and instructions are face downwards, Then shuffle the Gold Zone Destiny Card pack and wrap its titled sleeve round it. Place this pack, with all the numbers and blanks face downwards and underneath the Cellarer pile.

Finally, position the Yellow and Blue Zone packs of District Cards in numerical order on their relative spots, starting with Number 1 District Card at the top and Number 33 at the bottom in each case. Place the larger Property Cards on their grid near the four Gold Zone Squares. These Cards are numbered from Area Set No. 1 (Alsace) to Area Set No. 11 (White Burgundy). Position these Property Cards, like the District Cards, in numerical order (Area Set 1 at the top and Area Set No. 11 at the bottom). It is not essential to have every Property in exactly the order as quoted in the Index, but it will assist players who have a good knowledge of Wine Properties to have them in an order they will recognise from the merits of these names. To complete the pile, place the four Gold Zone Property Cards underneath the bottom Pink Zone Property Card (Area Set No. 11—Meursault).

Refer to the Indexes when you want to see the order or Properties as graded in their order of merit.

The Start of Play

The pieces

The pieces that are moved along are Barrels of colours Black, Red, Blue and Green. Black is the most important player and must be active in all games of VINESQUE—see Vintner. Black always starts first and is followed by Red, Blue and Green.

Direction of Play

Throw the single dice (extra dice is supplied in case of loss) and count your squares forwards. Never travel backwards unless authorised by Europa. In VINESQUE your first throw of a dice value of six will take you as far as Number 5 Yellow Zone square—Virginia, U.S.A. Be sure and count all the squares—Cellarer is one extra space.

As you land on each numbered square, pick up the respective District Card from either the Yellow or Blue Zone pack as the case may be. If any District Card has already been claimed there is no penalty to pay. You simply miss your chance of collecting that particular District Card.

There are no bonus turns if you throw a dice value of six.

The Vintner and Central Fund

The Vintner is responsible for checking that District Cards, Property Cards and Bonus Tickets are paid to the right players at the correct time. Choose your Vintner by either tossing a coin or by unanimous agreement. The Vintner may be either an elected player or an elected onlooker. If a player is chosen he/she must select a Black Barrel. And if an onlooker is chosen he/she should be able to stay throughout the game to ensure continuity. If this is not possible you may elect either another onlooker or ask the Black Barrel player to take over.

The Central Fund consists of Bonus Tickets (in Bottles and Rows of Vines) which are paid out by the Vintner to those players who land on Viewpoint squares. These Bonus Tickets are also paid out to players with a correct pair of Colour Sets in the Pink Zone. (See Viewpoints and Colour Sets for more details.)

The Yellow Zone

District Cards

These District Cards from the first section of VINESQUE in which there are 33 numbered squares. Each square belongs to a better known wine-growing country or state of the world outside Europe. Each Yellow Zone District Card is worth a Fund value in Bottles, which are graded according to the importance of the Wine District itself. There is also a short caption of wine information printed on each Card. Keep these Funds for purchasing opponents' Property Cards in the Pink Zone. All the Yellow Zone District Card squares become void when the first player enters the Pink Zone.

Each District Card has its own livery. The upper colour band belongs to the Zone (Yellow here), and the lower colour band belongs to the Colour Set. (See Colour Sets in the Pink Zone section.)

Cellarer

This important pack of 11 cards contains players' directives within the Pink Zone. The Cellarer squares occupy nine spaces in the Yellow Zone.

For the first and second landings on Cellarer, each player takes and keeps one Card from the top of the shuffled Cellarer pile. A maximum of two Cellarer Cards only is allowed to be collected during each game of VINESQUE.

If a player fails to collect any Cellarer Cards at all by the time he or she enters the Pink Zone, this player must miss two more turns before picking up one Cellarer Card. He or she may now enter the Pink Zone on the third turn. At least one Cellarer Card is needed for playing the Pink Zone.

All Cellarer squares become void when the first player reaches the Pink Zone.

Viewpoints

Yellow Zone squares 5, 10, 15, 20, 25 and 30 are marked with a symbol. Players who land on these squares earn an extra 100 Bottles which are paid for by the Vintner from the Central Fund. If the District Card is available, this can be collected as well.

The Blue Zone

District Cards

These District Cards form the second section of VINESQUE in which there are 33 numbered squares. Each square belongs to a better known wine-growing country or island of Europe outside France and Portugal. Each Blue Zone District Card is worth a Fund value in Rows of Vines, which are graded according to the importance of the Wine District itself. There is also a short caption of wine information printed on each Card. Keep these Funds for purchasing opponents' Property Cards in the Pink Zone. All the Blue Zone District Card squares become void when the first player enters the Pink Zone.

Each District Card has its own livery. The upper colour band belongs to the Zone (Blue here), and the lower colour band belongs to the Colour Set. (See Colour Sets in the Pink Zone section.)

Disaster Bin

This pack of 11 cards contains the penalties of VINESQUE. Players who land on these squares pick up a Disaster Bin Card from the top of the shuffled pile. Players will be told to lose certain District Cards that they may have collected within either the Yellow or Blue Zones. Return those affected District Cards to their own respective piles, ensuring that each one is placed back in its correct numerical spot. Return the Disaster Bin Card to the base of the pack face downwards.

Europa

This pack of 11 cards contains the movement directives of VINESQUE. Players who land on these squares pick up an Europa Card from the top of the shuffled pile. Players will be told to move either forwards or backwards from their current position on the board. Return the Europa Card to the base of the pack face downwards. You may not claim the District Card that you are directed to by Europa if that District Card is available. On your next turn, continue to collect available District Cards as normal.

Viewpoints

Blue Zone squares 5, 10, 15, 20, 25 and 30 are marked with a symbol. Players who land on these squares earn an extra 1 Row of Vines which is paid for by the Vintner from the Central Fund. If the District Card is available, this can be collected as well.

As soon as the first player reaches the Pink Zone all the other players advance to Europa next door to Blue Zone square Number 33 (Spain). Then proceed to play the Pink Zone in the same order as before. All Yellow and Blue Zone squares are now void.

The Pink Zone

Property Cards

These Property Cards form the third section of VINESQUE in which there are 30 numbered squares. Each square belongs to either well-known Wine Properties or Shippers in France, or to Port Lodges in Portugal. Each Property Card is worth a Fund value in both Bottles and Rows of Vines, which are graded according to the importance of the Wine Property/Shipper themselves. There is also a caption of wine information printed on each Card. Players start to obtain these Property Cards by way of their Cellarer Card(s), which provide the directive of their Area Set number(s).

Area Sets

Area sets cover 11 Wine Districts in the Pink Zone, 10 of which are in France and one in Portugal. Each player is able to collect one or two of these Area Sets free by way of Cellarer Card(s) collected in the Yellow Zone. Some Area Sets are more advantageous than others. This is the listing of the Pink Zone Area Sets:

| Pink Zone Area Sets | |
|---|---|
| Area Set 1 = | Alsace. Prime Square = Gewurztraminer. Ordinary Square = Riesling. |
| Area Set 2 = | Port (Douro). Prime Square = Taylor. Ordinary Squares = Warre and Fonseca. |
| Area Set 3 = | Champagne. Prime Square = Krug. Ordinary Squares = Bollinger and Moet & Chandon. |
| Area Set 4 = | Rhone. Prime Square = Hermitage. Ordinary Squares = Condrieu and Cote Rotie. |
| Area Set 5 = | St Emilion. Prime Square = Ch. Cheval-Blanc. Ordinary Square = Ch. Ausone. |
| Area Set 6 = | Graves, Prime Square = Ch. La Mission Haut-Brion. Ordinary Square = Ch. Haut-Brion. |
| Area Set 7 = | Red Burgundy. Prime Square = Chambertin. Ordinary Squares = Volnay, Les Musigny, Beaune, Richebourg and Clos de Vougeot. |
| Area Set 8 = | Haut Medoc. Prime Square = Ch. Lafite. Ordinary Squares = Ch. Montrose, Ch. Palmer, Ch. Latour, Ch. Margaux and CH. Mouton-Rothschild. |
| Area Set 9 = | Pomerol. Prime Square = Ch. La Croix de Gay. No Ordinary Squares. |
| Area Set 10 = | Sauternes. Prime Square = Ch. Coutet. No Ordinary Squares. |
| Area Set 11 = | White Burgundy. Prime Square = Meursault. Nor Ordinary Squares. |

The abbreviation "Ch."=Chateau, in the French language.

Direction of Play in the Pink Zone

Follow the direction of the arrows that are printed on every square. Only the middle corridor squares operate in both directions.

Sequence of Playing the Pink Zone

Collect a Prime Square by way of the Cellarer Card(s).

Collect one only valid Gold Zone Destiny Card (off each Prime Square claimed).

Collect your appropriate Property Card.

Collect any remaining Ordinary Squares within your Area Set.

Purchase opponents' Properties and use Colour Set concessions.

Prime Squares

Prime Squares refer to the chief Property within its Area Set. Each Prime Square Number has been encircled to highlight the position of these important Squares. Players must firstly claim a Prime Square from their Cellarer Card(s). For example, if a player owns a maximum allowance of Cellarer Card Numbers 2 and 10, he or she must land on either of these Prime Squares first—Area Set 2=Taylor (Port) or Area Set 10=Ch. La Croix de Gay (Sauternes)—in order to make progress in the Pink Zone.

Prime Squares are collected free with the correct Cellarer Card Number. Players may not purchase opponents' Prime Squares at any time—only the Ordinary Squares (after claiming their Prime Square(s)). Also, Prime Squares do not allow players to employ Colour set concessions—only Ordinary Squares.

Gold Zone Destiny Cards

This is a pack of 11 cards, wrapped by a sleeve, and it contains the final directive for players of VINESQUE. Once players have claimed their Prime Square, they take one card from the top of this shuffled pile. Never pick up a Gold Zone Destiny Card when claiming an Ordinary Square.

Only four of the 11 Gold Zone Destiny Cards are printed with the Gold Zone Area Set Numbers (7, 9, 10 and 11); the other seven cards are blank. If a player selects a blank Gold Zone Destiny Card this must be returned to the base of the pack with the blank face pointing downwards. Should the player hold no other Cellarer Card, and therefore has no opportunity to claim a Prime Square, he/she must resign from VINESQUE.

Once a player has collected their singular valid Gold Zone Destiny Card number, he/she is poised for the final section of VINESQUE—the Gold Zone.

Don't forget to collect your rightful Property Card now.

Ordinary Squares

Ordinary Squares are all the remaining ones in the Pink Zone's Area Sets that lie apart from the Prime Squares. Once a Prime Square has been claimed (free), all other squares within that Area Set may be claimed free as well, assuming no opponent has bought some already. Only Ordinary Squares (not Prime Squares) allow players to employ Colour Set concessions.

Some Area Sets only contain a Prime Square (Area Sets 9, 10 and 11). However, if a player owns Cellarer Cards Numbers 7 and 8, this is the most powerful combination in VINESQUE—namely Red Burgundy and Haut Medoc. These Area Sets have five Ordinary Squares in each one. Opponents must seize the initiative by trying to stall such players' good fortunes by purchasing Ordinary Squares in these strong Area Sets. But remember you can only purchase such Squares after you have claimed your first Prime Square.

Colour Sets

Each Yellow and Blue District Card and each Pink Zone Property Card have two colour bands printed on them. The top band relates to its particular Zone—Yellow, Blue or Pink. The lower (waistline) band relates to the Colour Set. Listed below are the Colour Sets in VINESQUE, and which Group of District Cards allows Colour Set concessions in the Pink Zone.

| COLOUR SET | PINK ZONE AREA SET NO | GROUP OF YELLOW ZONE DISTRICT CARDS | GROUP OF BLUE ZONE DISTRICT CARDS |
|---|---|---|---|
| Black | 1 | 1–5 North-East USA | 1–5 Greece, Balkan States, Yugoslavia |
| Light Green | 2 | 6–8 Mississippi USA | 6–9 Hungary, Czechoslo-slovakia, U.K. |
| Pink | 3 | 9–11 NW Pacific USA | 10–14 Germany |
| Brown | 4 | 12–14 California USA | 15 Belgium |
| Yellow | 5 | 15–16 Bordering Caribbean | 16–17 Switz-erland and Austria |
| Light Blue | 6 | 17–18 E. Coast of S. America | 18–20 Northern Italy |
| Mauve | 7 | 19–20 Andes, S. America | 21–23 Central Italy |
| Dark Green | 8 | 21–22 New Zealand | 24–27 Southern Italy |

When Colour Sets are used

Colour Sets are used when a player wishes to buy a square outside his/her own Area Set(s), after having claimed their own Prime Square(s). Should an opponent have claimed a Prime Square in a large Area Set (like Numbers 7 or 8), this will indicate that action is needed to stall further progress. So opponents try to land on as many Ordinary Squares as possible and buy them away from the player who can claim them free with their Cellarer Card(s).

When buying Ordinary Squares the opposing player must employ all the concessions available to him/her.

For example: your opponent has just landed on Area Set Prime Square 8=Ch. Lafite (Haut Medoc). This means that this player has five Ordinary Squares in this Area Set to claim free. Now is the time for your to act fast. By chance, you land on Area Set 8 Ch. Palmer (Haut Medoc). This is what you do.

Colour Set Concessions

You have chosen to buy Area Set Number 8 Ch. Palmer (Haut Medoc) to prevent your opponent from completing his/her own Area Set on a free exchange of Cellarer Card to Property Card. The Fund value for Ch. Palmer is 1500 Bottles and 15 Rows of Vines. If you do not have the right Colour Sets you must pay for this Property Card by way of District Card and Bonus Ticket Funds. You owe both 1500 Bottles and 15 Rows of Vines. On the other hand, check your District Cards Colour Sets (the colour band on the waist-line). The chart of Colour Sets above shows you that Area Set Number 8 is Dark green. So check for the following:

if you own either Numbers 21 or 22 Yellow Zone District Cards (New Zealand), Ch. Palmer will cost 15 Rows of Vines only. The Bottles are free;

if you own Numbers from 24–27 Blue Zone District Cards (Southern Italy), Ch. Palmer will cost 1500 Bottles only. The Rows of Vines are free;

if you own one or more cards from both New Zealand and Souther Italy you can claim Ch. Palmer entirely free. The Vintner will also pay you a Central Fund Bonus of 200 Bottles and 2 Rows of Vines. Players who hold this combination of a Colour Set offer the biggest threats to opponents at this point of VINESQUE.

Players may on occasions find that they do not hold exact Fund amounts for Property purchases. The Vintner will give any change from the Central Fund in Bonus Tickets.

The Gold Zone

This is the fourth and final section of VINESQUE, in which there are four numbered Area Set Squares (7, 9, 10 and 11). These squares refer to the most famous Wine Properties in the world. The winner is the first player to claim one of these Gold Zone Properties with the following highest combination The Fund Value of the claimed Gold Zone Square and A balance of Pink Zone Property Cards.

Remember that neither District Card Funds nor Bonus tickets hold any winning value once players enter the Pink Zone. District Card Funds should, therefore, be transferred into Pink Zone Properties as much as possible.

Entering the Gold Zone

You may only enter the Gold Zone from Area Set Number 8 Ch. Lafite (Haut Medoc). But before you do enter this final section make sure of the following:

that you will land exactly on your intended square;

and that you hold sufficient Pink Zone Property Card Funds for transferring into the Gold Zone Property. Don not use your District Card Funds.

Players are disqualified if they enter the Gold Zone and miss their intended square.

For example, a player holds Destiny Card Number 9 for Ch. Petrus (Pomerol). This Gold Zone Property is worth the highest Fund value in VINESQUE and has 6000 Bottles and 60 Rows of Vines in Fund value. In order to claim this square the player must own a Pink Zone Property Card value of at least this amount. So when he/she pays for this Gold Zone Square, a Pink Zone Property Card Fund value of at least 6000 Bottles and 60 Rows of Vines must be transferred. These Property Cards are returned to the Property Card pile. No change may be given by the Vintner when exchanging Pink Zone Property Cards into Gold Zone Property Cards.

It should be noted that neither the District Card nor Bonus Ticket Funds hold any winning value once players enter the Pink zone. District Cards and Bonus Ticket Funds should therefore be transferred into Pink Zone Properties as much as possible.

Now count up the Fund value of Ch. Petrus and your balance of Pink Zone Property Cards. You may be declared the winner if opponents know they cannot match it; on the other hand, there may be one more player who is ready to challenge you.

What is claimed is:

1. Board game apparatus comprising a board, which board comprises a first sector and a second sector, the first sector comprising a first path of locations, at least some of said locations are sequentially numbered and other locations relate to game instructions;

the second sector comprising a network of paths comprising further locations, which locations relate to the gaining of assets, which apparatus further comprises a first pack of cards relating to assets associated with said numbered locations, a second pack of cards giving game instructions, a third pack of cards relating to the assets to be gained in said second sector, player markers, at least one die, and a fourth pack of cards relating to a winning set of assets.

2. Board game apparatus according to claim 1, wherein the first sector comprises two zones.

3. Board game apparatus according to claim 2, wherein the assets in the first zone have a first range of values and the assets of the second zone have a second range of values higher than the first range.

4. Board game apparatus according to claim 2, wherein the second sector comprises a third zone.

5. Board game apparatus according to claim 4, wherein the second sector includes a fourth zone containing a plurality of said winning assets.

6. Board game apparatus according to claim 5, wherein each of a plurality of prime locations of the third zone indicates a particular special property which the holder of that prime location must endeavour to purchase in order to win the game.

7. Board game apparatus according to claim 5, wherein each location in the fourth zone is identified with a special property.

8. Board game apparatus according to claim 7, wherein each location comprises a high quality vineyard or chateau.

9. Board game apparatus according to claim 1, wherein the first sector has a plurality of special locations interspersed with the numbered locations of the first sector, a player landing on a special location receiving, selectively, a bonus, a forfeit or a pass to the second sector.

10. Board game apparatus according to claim 9, wherein in the first or second zone the pass consists of a Cellarer card representative of a type of wine.

11. Board game apparatus according to claim 1, wherein the zones are coloured, the first zone being yellow, the second blue, the third pink and the fourth gold.

12. Board game apparatus according to claim 1, wherein the assets in the first zone comprises of bottles of wine;

in the second zone, each numbered location is representative of a certain area and its assets comprise rows of vines;

the third zone comprises thirty locations divided into eleven regions each region having a prime location;

and the fourth zone comprises only four locations.

* * * * *